US007877917B2

(12) United States Patent
Cinciu

(10) Patent No.: US 7,877,917 B2
(45) Date of Patent: Feb. 1, 2011

(54) HUNTING RIFLE RECOILLESS BUTTSTOCK

(75) Inventor: Vasile Cinciu, Bucharest (RO)

(73) Assignee: Century International Arms Corporation, Delray Beach, FL (US)

( * ) Notice: Subject to any disclaimer, the term of this patent is extended or adjusted under 35 U.S.C. 154(b) by 735 days.

(21) Appl. No.: 11/909,151

(22) PCT Filed: Mar. 22, 2006

(86) PCT No.: PCT/RO2006/000005

§ 371 (c)(1),
(2), (4) Date: Sep. 19, 2007

(87) PCT Pub. No.: WO2006/101410

PCT Pub. Date: Sep. 28, 2006

(65) Prior Publication Data

US 2008/0178508 A1 Jul. 31, 2008

(30) Foreign Application Priority Data

Mar. 22, 2005 (RO) ..... 05-0266

(51) Int. Cl.
*F41A 21/00* (2006.01)

(52) U.S. Cl. ..... 42/1.06; 42/74

(58) Field of Classification Search ..... 42/1.06, 42/74

See application file for complete search history.

(56) References Cited

U.S. PATENT DOCUMENTS 480,587 A * 8/1892 Townsend ..... 42/74
2,731,753 A 1/1956 Mathieu
3,207,496 A * 9/1965 Hrebicek ..... 267/172
3,208,179 A * 9/1965 Hrebicek ..... 42/74
3,209,482 A * 10/1965 Kuzma et al. ..... 42/74
3,604,138 A 9/1971 Wilson
3,754,344 A 8/1973 Spiliotis
4,316,342 A * 2/1982 Griggs ..... 42/74
4,663,877 A * 5/1987 Bragg ..... 42/74
5,031,348 A * 7/1991 Carey ..... 42/74

(Continued)

FOREIGN PATENT DOCUMENTS

DE 199 08 340 8/2000

OTHER PUBLICATIONS

ISR mailed Jun. 21, 2006 in PCT/RO2006/000005.

(Continued)

*Primary Examiner*—Michael Carone
*Assistant Examiner*—Michael D David
(74) *Attorney, Agent, or Firm*—Hershkovitz & Associates, LLC; Abraham Hershkovitz

(57) ABSTRACT

Stock for a recoilless hunting rifle, for medium and large caliber hunting guns, which eliminates the stress produced by the effect of the recoil on the shooter's shoulder, providing at the same time good targeting precision and reduced consumption of bullet cartridges or shot cartridges. The stock has a stock butt and a mechanical anti-recoil module, with fast assembling, and a gun stock resembling the classical gun stocks but without transferring the recoil force to the shooter's shoulder. The recoilless buttstock includes a mechanical anti-recoil module, presented as an assembly having a pair of coupling parts, an elastic mechanism, a fixed support with rollers, an upper guide with a spring, a lower guide with a spring and the case of the stock.

7 Claims, 9 Drawing Sheets

U.S. PATENT DOCUMENTS

| | | | | | |
|---|---|---|---|---|---|
| 5,375,360 | A | * | 12/1994 | Vatterott | 42/74 |
| 5,392,553 | A | * | 2/1995 | Carey | 42/73 |
| 5,457,901 | A | * | 10/1995 | Gernstein et al. | 42/1.06 |
| 5,752,339 | A | | 5/1998 | Bentley et al. | |
| 5,974,718 | A | | 11/1999 | Bentley et al. | |
| 5,979,098 | A | * | 11/1999 | Griggs | 42/73 |
| 6,481,142 | B1 | * | 11/2002 | McCarthy | 42/74 |
| 6,481,143 | B2 | * | 11/2002 | McCarthy | 42/74 |
| 6,564,493 | B1 | * | 5/2003 | Forman | 42/74 |
| 6,732,466 | B2 | * | 5/2004 | Bentley | 42/74 |
| 7,493,717 | B2 | * | 2/2009 | Gussalli Beretta | 42/74 |
| 7,681,351 | B2 | * | 3/2010 | Bucholtz et al. | 42/1.06 |
| 2008/0258363 | A1 | * | 10/2008 | Cinciu | 267/136 |

OTHER PUBLICATIONS

Written Opinion of the International Searching Authority mailed Jun. 21, 2006 in PCT/RO2006/000005.

* cited by examiner

HUNTING RIFLE RECOILLESS BUTTSTOCK

RELATED APPLICATIONS

This application is a 371 application of International Patent Application No. PCT/RO2006/000005, filed on Mar. 22, 2006, which claims priority from Romanian Patent Application No. A200500266, filed on Mar. 22, 2005.

BACKGROUND OF THE INVENTION

This invention relates to a hunting rifle recoilless buttstock, intended to be used for medium and large caliber hunting rifles, in order to eliminate stress produced by a recoil force in a shooter's shoulder, providing at the same time a good targeting precision and a reduced consumption of ammunition.

A classical hunting rifle is known, in which, in order to partially eliminate a recoil force in a shooter's shoulder at firing, the butt of the stock has a rubber cap with rectangular openings, which practically does not absorb the impact, attenuating only a small percentage of the recoil force, which leads to a high stress and fear for the shooter.

SUMMARY OF THE INVENTION

The technical issue that this invention addresses is to totally or partially reduce the effect of the shock in the shooter's shoulder, generated by the recoil force at the firing moment, when a bullet leaves the barrel.

Furthermore, this invention allows simultaneous elimination of a recoil force effect while increasing a targeting precision and saving bullet cartridges or shot cartridges.

The hunting rifle recoilless buttstock according to this invention avoids the aforesaid drawbacks, comprising a forend that connects a stock and a receiver, and a mechanical anti-recoil module connected to the butt of the stock through a vertical blocking screw.

The hunting rifle recoilless buttstock according to this invention avoids the aforesaid drawbacks by using a stock butt comprising a butt's body having a stock shape, provided with holes, an entry, a vertical hole, cylindrical openings, a fastening screw for the receiver, a first plug and a second plug.

The hunting rifle recoilless buttstock according to this invention avoids the aforesaid drawbacks by attaching a mechanical anti-recoil module to the gun stock's butt through a vertical screw, providing a classical stock butt configuration.

The mechanical anti-recoil module according to this invention avoids the aforesaid drawbacks by comprising a pair of coupling parts, an anti-recoil elastic mechanism, a fixed support with rollers, an upper guide with a spring, a lower guide with a spring and a case of the stock.

The mechanical anti-recoil module according to this invention avoids the aforesaid drawbacks by comprising a fixed joint plate provided with mounting holes, screwed fitting and rods provided with gliding longitudinal notch, securing screws, joint pivots, locks, a pair of pushing levers, joint spring carrying pivots, absorption springs, elongated levers, a gliding spring carrying joint rivet, washers, screwed spring carrying pivots, and annulling springs.

The fixed support with rollers according to this invention avoids the aforesaid drawbacks by guiding and blocking the elongated levers carrying blocking-compensation springs and annulling springs which store and cancel the recoil energy.

The fixed support with rollers according to this invention comprises a fixed central support, roller carrier pivots, blocking rollers, a blocking-compensation spring, a bed plate, mounting screws, an adjustment screw, and screwed spring carrying pivots. The fixed support with rollers according to this invention is provided with a circular notch, a longitudinal opening, passage holes, screwed passage holes for mounting working accessories which can include a blocking-compensation spring, roller carrier pivots, and screwed roller carrier pivots.

The upper guide with a spring according to this invention avoids the aforesaid drawbacks by connecting the coupling parts with the bed plate, at the same time absorbing and storing part of the recoil energy.

The upper guide with a spring according to this invention comprises a screwed rod assembly, an ending ring, an upper return spring, a guiding bolt, a screwed guiding member, and a bolt nut.

The lower guide with a spring according to this invention avoids the aforesaid drawbacks by acting as a mobile connector between the coupling part and the bed plate, forming a parallelogram whose shape is deformable in the direction of the recoil force.

The lower guide with a spring according to this invention comprises a screwed rods assembly, a spring guiding ring, a lower return spring, a guiding bolt, a screwed guiding member, and a bolt nut.

The hunting rifle recoilless buttstock removes the aforementioned drawbacks by introducing the elastic anti-recoil mechanism, the coupling parts, the combined central support, the upper guide and the gliding lower guide into the stock case having the shape and aspect of a classical hunting rifle stock, which is mounted on the receiver of the gun with square shoulder screws, thereby obtaining the configuration of a classical hunting gun stock.

The hunting rifle recoilless buttstock according to this invention has the following advantages:

- It removes stress applied on a shooter's shoulder which is generated by the impact of the recoil force on the shooter's shoulder;
- It increases a targeting precision and a bullet grouping in a target; and
- It reduces the excessive consumption of bullet cartridges or shot cartridges.

BRIEF DESCRIPTION OF THE DRAWINGS

The following is an example of implementing the invention, in connection with FIGS. 1 to 9, which represent.

DETAILED DESCRIPTION OF THE PRESENT INVENTION

Figure 1:
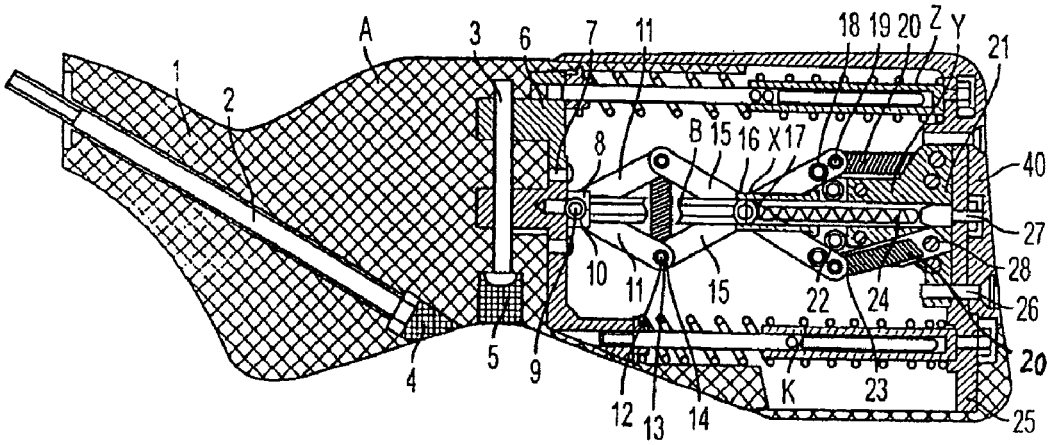
FIG. 1—A side cross-sectional view of the recoilless hunting rifle stock.
Figure 2:
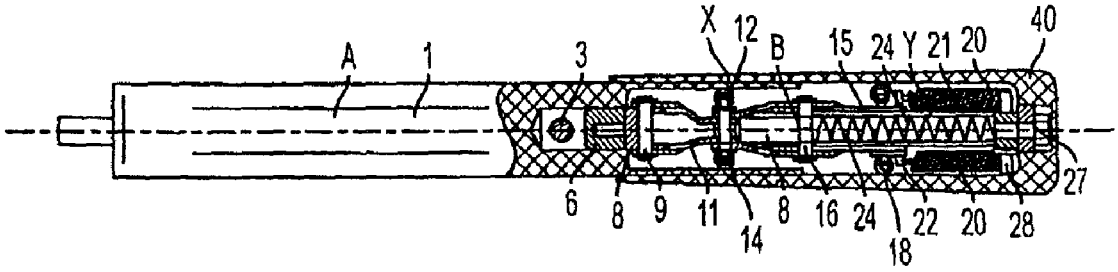
FIG. 2—A top cross-sectional view of the recoilless hunting rifle stock in FIG. 1.

The hunting rifle recoilless buttstock according to this invention can include a stock butt A and a mechanical anti-recoil module B (FIG. 1).

Figure 3:
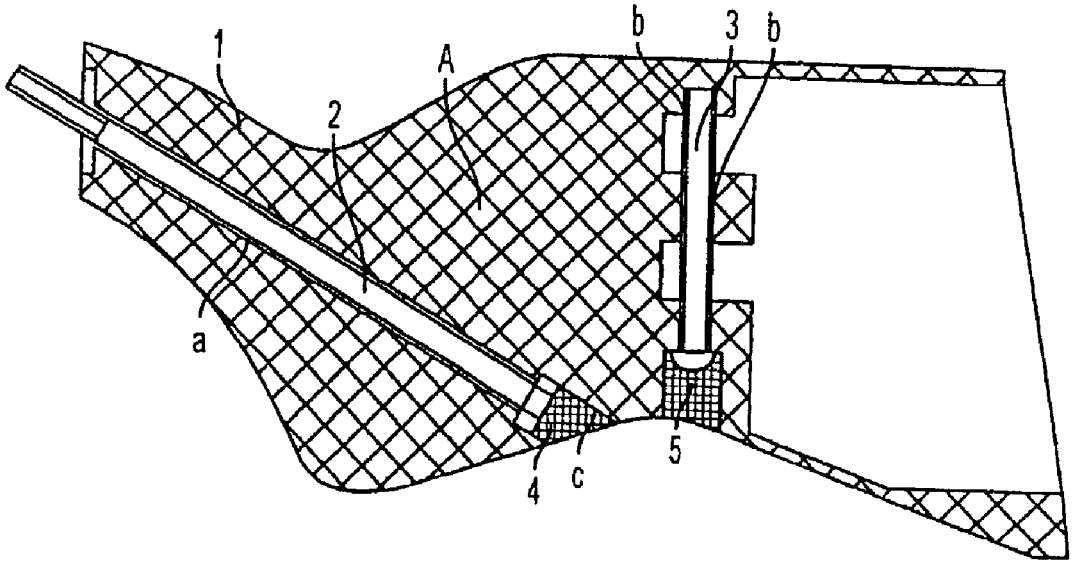
FIG. 3—A side cross-sectional view of the stock coupling forend A in FIG. 1.

The stock butt A (FIG. 3) can include a stock body 1, provided with a passing hole a, a screwed vertical hole b and the cylindrical elements c, continuing with a mounting screw 2, a vertical blocking screw 3, a first plug 4 and a second plug 5.

Figure 4:
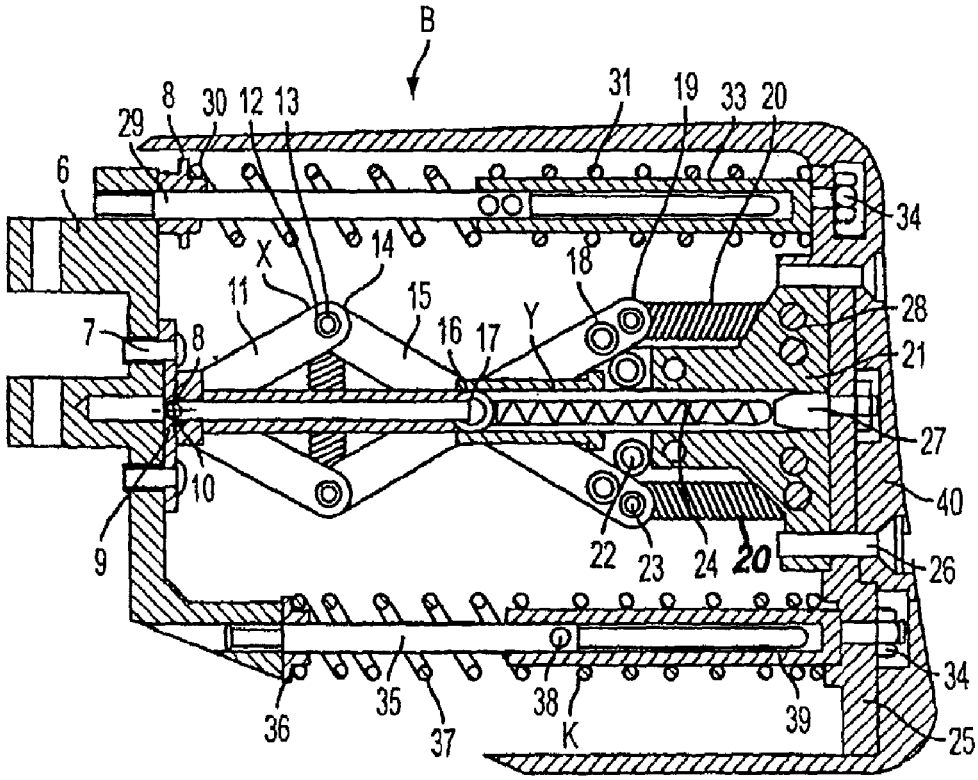
FIG. 4—A side cross-sectional view of the mechanical anti-recoil module B in FIG. 1, FIG. 5—A side elevation view of the elastic anti-recoil mechanism X in FIG. 4.

The hunting rifle recoilless buttstock according to this invention can include a mechanical anti-recoil module B which takes up, absorbs and cancels a recoil force and comprises a pair of coupling parts 6, two mounting screws 7, an elastic anti-recoil mechanism X, a fixed support with rollers Y, an upper guide with a spring Z, a lower guide with a spring K and a case of a stock 40 (FIG. 1 and FIG. 4).

Figure 5:
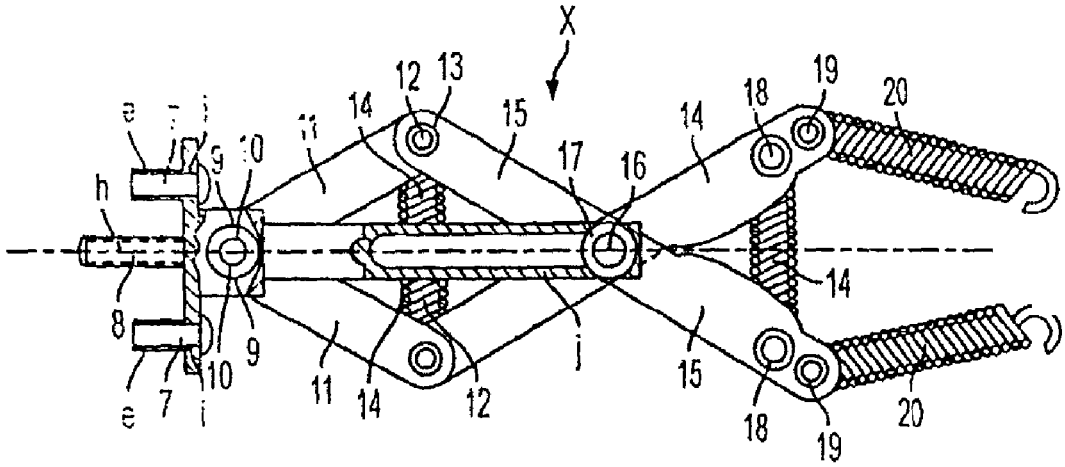
Figure 6:
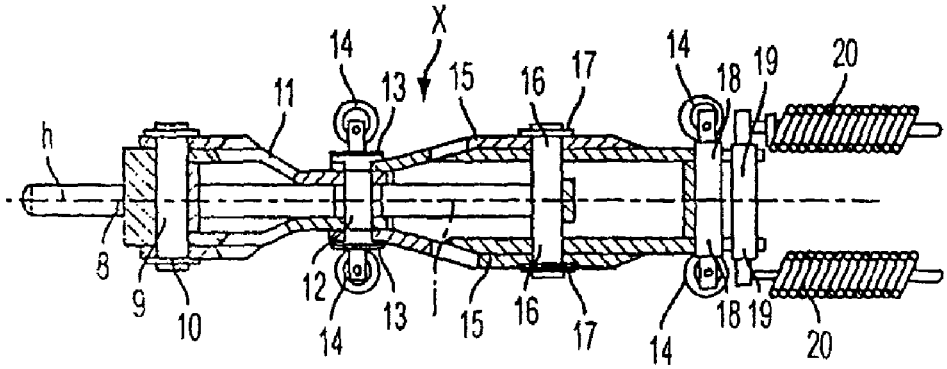
FIG. 6—A top elevation view of the elastic anti-recoil mechanism X in FIG. 5.

The elastic anti-recoil mechanism X (FIG. 5, FIG. 6) according to this invention can include a fixed joint plate 8, provided with passing holes l, screwed fitting e and a rod h provided with gliding notch j, and furthermore a joint pivot 9, a lock 10, a pair of pushing levers 11, joint spring carrying pivots 12, locks 13, a first absorption spring 14, a pair of elongated levers 15, a joint rivet 16, washers 17, a first pair of screwed spring carrying pivots 18, a second absorption spring 14, a second pair of screwed spring carrying pivots 19 and a pair of annulling springs 20.

Figure 7:
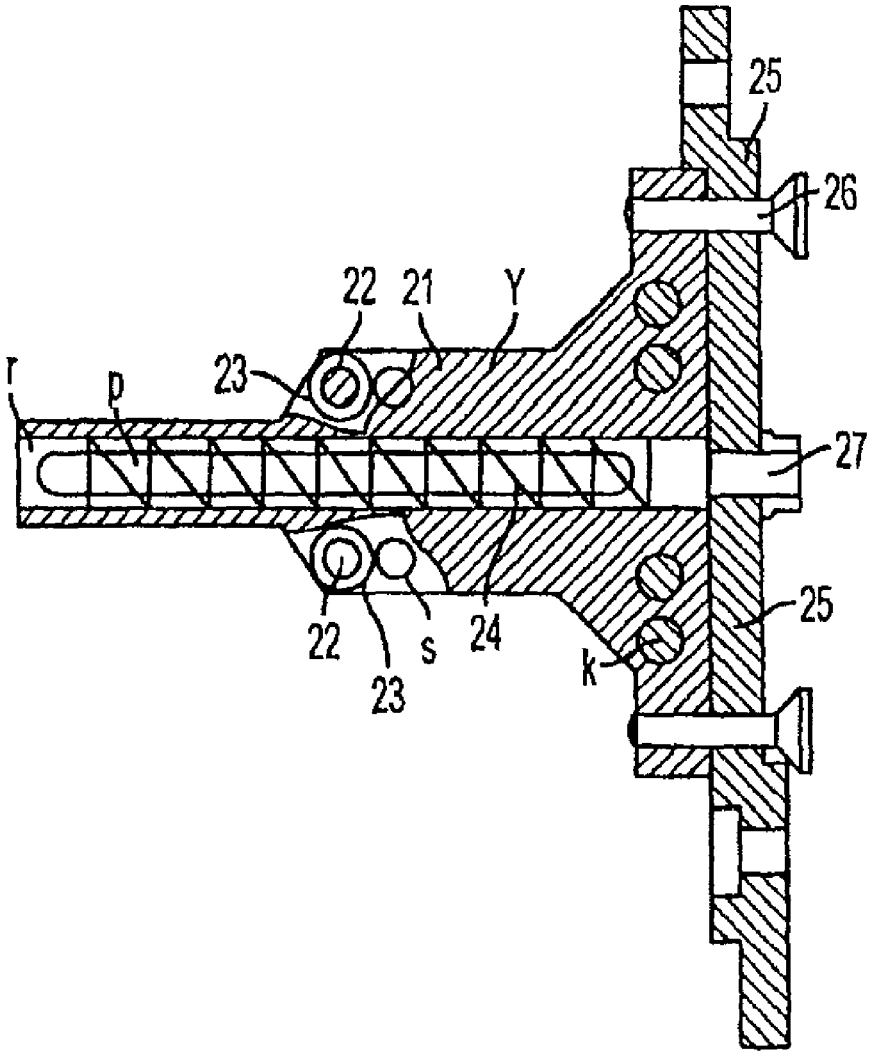
FIG. 7—A side cross-sectional view of the fixed support with rollers Y in FIG. 1.

The fixed support with rollers Y (FIG. 4, FIG. 7) according to this invention can include a fixed central support 21, roller carrier pivots 22, blocking rollers 23, a blocking-compensation spring 24, a bed plate 25, mounting screws 26, an adjustment screw 27, another pair of screwed spring carrying pivots 28.

The fixed support with rollers Y (FIG. 4, FIG. 7) according to this invention can be provided with the following elements: a circular notch r, a longitudinal opening p, passage holes s, screwed passage holes k.

Figure 8:
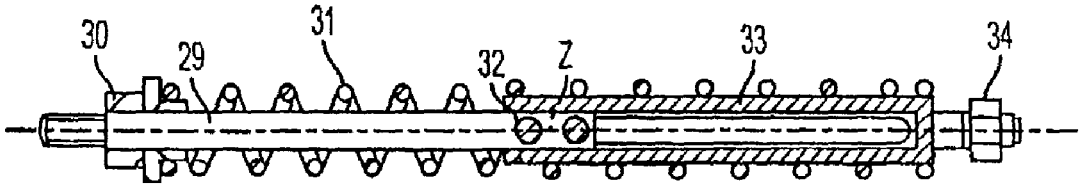
FIG. 8—A side cross-sectional view of the upper guide with spring in FIG. 1.

The mechanical anti-recoil module B (FIG. 4) according to this invention can include an upper guide with a spring Z (FIG. 8) which comprises a screwed rod assembly 29, an ending ring 30, an upper return spring 31, a guiding bolt 32, a screwed guiding member 33, and a bolt nut 34.

Figure 9:
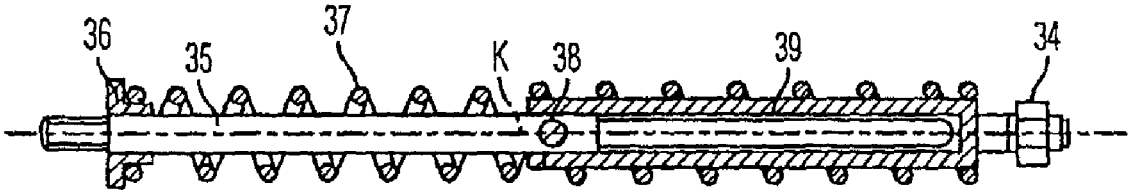
FIG. 9—A side cross-sectional view of the lower guide with spring in FIG. 1.

The mechanical anti-recoil module B according to this invention can include a lower guide with a spring K (FIG. 9) according to this invention which comprises a screwed rod assembly 35, a guiding ring 36, a lower return spring 37, a guiding bolt 38, a screwed guiding member 39, and a bolt nut 34.

The hunting rifle recoilless buttstock according to this invention (FIG. 1, FIG. 4) can include a stock case 40, having the shape and aspect of a classical hunting rifle stock.

The invention claimed is:

1. A hunting rifle recoilless buttstock comprising:

a stock body provided with a passing hole and a mounting screw;

an anti-recoil module comprising a pair of coupling parts, an elastic anti-recoil mechanism, a fixed support with rollers, an upper guide with a first spring and a lower guide with a second spring;

the elastic anti-recoil mechanism comprising:

a fixed joint plate, which is coupled to ends of a pair of pushing levers by way of a joint pivot having a lock;

the other end of the pair of pushing levers being coupled to each end of a pair of elongated levers by a joint spring carrying pivot having a lock;

the elongated levers being joined at their centers by a joint rivet, while the other ends of the elongated levers are coupled to screwed spring carrying pivots; and a first absorption spring, a second absorption spring, annulling springs and a blocking-compensation spring;

wherein the elastic anti-recoil mechanism has an operation relationship to said fixed support with rollers and upper and lower return springs.

2. The hunting rifle recoilless buttstock of claim 1, wherein the first absorption spring is arranged between the joint spring carrying pivots at each of their ends, the second absorption spring is arranged between the screwed spring carrying pivots at each of their ends, while the annulling springs with the respectively screwed spring carrying pivots, are arranged between the back ends of the elongated levers and the fixed support with rollers.

3. The hunting rifle recoilless buttstock of claim 1, wherein the fixed support with rollers comprises a fixed central support, blocking rollers, which are mounted on corresponding roller carrier pivots, a blocking-compensation spring, which is mounted within a circular notch, the fixed central support being fitted on a bed plate with mounting screws.

4. The hunting rifle recoilless buttstock of claim 1, wherein at its upper and lower parts, the fixed central support has screwed spring carrying pivots for the annulling springs, and the bed plate is provided with an adjustment screw.

5. The hunting rifle recoilless buttstock of claim 1, wherein the entire anti-recoil module is enclosed in a stock case which is fitted with the mounting screws.

6. The hunting rifle recoilless buttstock of claim 1, wherein the upper guide with a first spring comprises a screwed rod assembly, an ending ring, an upper return spring, a guiding bolt, a screwed guiding member and a bolt nut.

7. The hunting rifle recoilless buttstock of claim 1, wherein the lower guide with a second spring comprises a screwed rod assembly, an ending ring, a lower return spring, a guiding bolt, a screwed guiding member and a bolt nut.

* * * * *